US006363539B2

(12) United States Patent
Tachi et al.

(10) Patent No.: US 6,363,539 B2
(45) **Date of Patent: *Apr. 2, 2002**

(54) COMPOSITE HELMET

(75) Inventors: Yoshishiro Tachi, Fujieda; Takao Oota, Tsu, both of (JP)

(73) Assignee: Sumitomo Bakelite Company Limited, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/210,959

(22) Filed: Dec. 15, 1998

(30) Foreign Application Priority Data

| | | |
|---|---|---|
| Dec. 18, 1997 | (JP) | 9-349558 |
| Dec. 18, 1997 | (JP) | 9-349559 |
| Dec. 18, 1997 | (JP) | 9-349560 |
| Dec. 25, 1997 | (JP) | 9-358377 |
| Dec. 25, 1997 | (JP) | 9-358378 |
| Dec. 25, 1997 | (JP) | 9-358379 |
| May 20, 1998 | (JP) | 10-138232 |
| May 20, 1998 | (JP) | 10-138233 |
| May 20, 1998 | (JP) | 10-138234 |
| Jul. 31, 1998 | (JP) | 10-217057 |
| Sep. 10, 1998 | (JP) | 10-257039 |
| Sep. 30, 1998 | (JP) | 10-278587 |

(51) Int. Cl.[7] ..... A42B 3/00
(52) U.S. Cl. ..... 2/412; 2/410
(58) Field of Search ..... 2/410, 411, 412, 2/422, 425, 6.6, 6.8, 2.5, 171, 171.02, 205, 209.13, 5; D29/102, 103; D2/865, 885, 891, 892

(56) References Cited

U.S. PATENT DOCUMENTS

| | | | | |
|---|---|---|---|---|
| 2,082,083 A | * | 6/1937 | Swift | 2/175 |
| 2,971,082 A | * | 2/1961 | Frank | 240/60 |
| 3,242,500 A | * | 3/1966 | Derr | 2/412 |
| 3,435,460 A | * | 4/1969 | Grant | 2/422 |
| 3,871,026 A | * | 3/1975 | Dorre | 2/410 |
| 4,466,138 A | | 8/1984 | Gessalin | 2/243 |
| 4,908,877 A | | 3/1990 | White | 2/6 |
| 4,937,888 A | * | 7/1990 | Straus | 2/411 |
| 5,054,122 A | * | 10/1991 | Sher | 2/7 |
| 5,309,576 A | * | 5/1994 | Broersma | 2/412 |
| 5,561,866 A | * | 10/1996 | Ross | 2/410 |
| 5,953,762 A | * | 9/1999 | Corbett | 2/425 |
| 6,029,283 A | * | 2/2000 | Comstock et al. | 2/422 |

FOREIGN PATENT DOCUMENTS

| | | |
|---|---|---|
| JP | A-8-192497 | 7/1996 |

* cited by examiner

*Primary Examiner*—Michael A. Neas
(74) *Attorney, Agent, or Firm*—Smith, Gambrell & Russell, LLP

(57) ABSTRACT

A helmet body is mounted or fixed detachably or undetachably a hollow molding or a ceramic-fixed hollow molding to enhance the impact resistance of the helmet body and weight-save the composite helmet, thereby increasing the adaptability. The composite helmet has excellent impact resistance. The outer surface of the helmet body is composed of a plastic or a metal and is mounted or fixed with a hollow molding having an external, truncated pyramid or cone shape so that the external shape of the hollow molding becomes similar to the external shape of the helmet body. It is preferable that the hollow molding has such a shape that at least two kinds of the starting hollow moldings having different, external, truncated pyramid or cone shapes are put one on another and integrally bonded so as to make the integrated boundary surface smooth and make the external shape of the resulting hollow molding more similar to the external shape of the helmet body.

50 Claims, 12 Drawing Sheets

COMPOSITE HELMET

BACKGROUND OF THE INVENTION

1. Field of the Invention

This invention relates to a composite helmet comprising a helmet body composed of a plastic or a metal and a hollow molding having a truncated pyramid or cone shape mounted or fixed detachably or undetachably on the outer surface of the helmet body so as to make the external shape of the hollow molding similar to the external shape of the helmet body, and if necessary, ceramic chips are fixed on the whole or a part of the surface of the hollow molding, said hollow molding being freely detachable, whereby when an object coming flying at a high speed hits against the helmet, substantially all the energy of the object coming flying is absorbed by the partial breakage of the hollow molding having a truncated pyramid or cone shape or by the partial breakage of the ceramic or both the ceramic and the hollow molding to effectively prevent the helmet body from being impaired and bulged inside, and hence, said composite helmet has good impact resistance against an object coming flying at a high speed.

Moreover, this invention relates to a composite helmet uniformalized in thickness, lessened in volume and weight-saved by allowing the above hollow molding to have an external shape extremely similar to the external shape of the helmet body, that is, to have a truncated, bisymmetric pyramid or pseudocone shape.

2. Statement of the Related Art

It is a well-known fact that a helmet can serve as an impact resistant body against an object falling down from a high place or an object coming flying. However, when the impact force is large, it is impossible in many cases that the helmet, when used alone, softens said impact force.

It is now a known fact that, in general, an impact resistant body against an object falling down from a high place or an object coming flying at a high speed is provided by bonding ceramics to a plate of a high-strength fiber-reinforced plastic (referred to hereinafter as ACM). Moreover, a technique for bonding a ceramic plate having a curved surface to an ACM plate having a curved surface has been used in Japan and abroad in the field of a bullet-resistant plate for a bulletproof vest or the like. The present applicant filed a Japanese patent application (JP-A-8-192,497) as to this technique.

However, a helmet has a three-dimensional curved outer surface which varies continuously, and when ceramic chips are fixed directly on said outer surface, it is desirable to make the back surface shapes of the ceramic chips identical with the outer surface shape of the helmet. However, it is actually impossible in the economical and technical aspects to prepare a ceramic molding having such a shape. On the other hand, even when it is intended to prepare several kinds of ceramic chips so as to fit the outer surface of the helmet and fix them on the helmet, such portions that the ceramic chips do not fit the outer surface of the helmet are caused on the helmet and spaces are formed among the ceramic chips and between the ceramic chip and the helmet, resulting in decrease of bullet resistance. Therefore, it is necessary to improve this point. Furthermore, once ceramic chips are fixed on the helmet, it is difficult to remove the ceramic chips, and even when there is no risk of an object falling down from a high place or an object coming flying at a high speed at all, it has been always necessary to wear a heavy weight ceramic-fixed helmet.

The present inventors have accomplished a composite helmet excellent in impact resistance by mounting or fixing a hollow molding having an external, truncated pyramid or cone shape on the outer surface of a helmet body composed of a plastic or a metal, and, if necessary, further fixing ceramic chips on the whole or a part of the surface of the hollow molding. That is, the composite helmet has no spaces among the ceramic chips and between the ceramic chip and the hollow molding and in the composite helmet, even when the helmet receives a strong impact force, the impact force applied to the helmet body composed of a plastic or a metal is softened because the breaking energy thereof is transmitted to the helmet body through the hollow molding or the ceramic-fixed hollow molding, and simultaneously the helmet is effectively prevented from being bulged inside. In addition, the present inventors have accomplished a weight-saved composite helmet by using a hollow molding having an external, truncated, bisymmetric pyramid or pseudocone shape for making the external shape of the hollow molding more approximate to the external shape of the helmet body.

SUMMARY OF THE INVENTION

According to this invention, there is provided a composite helmet which comprises a helmet body composed of a plastic or a metal and a hollow molding having an external, truncated pyramid or cone shape mounted or fixed detachably or undetachably on the outer surface of the helmet body.

According to this invention, there is further provided a composite helmet which comprises a helmet body composed of a plastic or a metal and a ceramic-fixed hollow molding having an external, truncated pyramid or cone shape mounted or fixed on the outer surface of the helmet body, wherein the ceramic chips are fixed on the whole or a part of the surface of the hollow molding.

The composite helmet of this invention is preferably characterized in that the hollow molding is of such a type that at least two kinds of starting hollow moldings having different truncated pyramid or cone shapes are put one on another and integrally bonded to one another so as to make the integrated boundary surface smooth and make the external shape of the resulting hollow molding more similar to the external shape of the helmet body. Moreover, the other preferable composite helmet of this invention is characterized in that the above hollow molding is of such a type that in order to make the external shape of the resulting hollow molding much more similar to the external shape of the helmet body, a part of the starting hollow molding is cut off vertically to the base of the pyramid or cone in a certain width along the center line of the base so that the center line comes to the center of the width and the two divisions remaining after the cutting off are integrally bonded to each other to allow the resulting hollow molding to have a truncated, bisymmetric, pyramid or pseudocone shape.

BRIEF DESCRIPTION OF THE DRAWINGS

FIG. 9 (*c*) is the plan showing that the center portion of the starting hollow molding having an external, truncated, regularly octagonal pyramid shape is cut off in a certain width (T) vertically to the base of the pyramid for forming the above hollow molding having an external, truncated, bisymmetric, octagonal pyramid shape; and FIG. 9 (*d*) is the plan of the hollow molding having an external, truncated, bisymmetric, octagonal shape formed by bonding the two divisions (W) remaining after the cutting off.

FIG. 10 (*c*) is the plan showing that the center portion of the starting hollow molding having an external, truncated cone shape is cut off in a certain width (T) vertically to the base of the cone for forming the above hollow molding having an external, truncated, bisymmetric pseudocone shape; and FIG. 10 (*d*) is the plan of the hollow molding having a truncated, bisymmetric, pseudocone shape formed by bonding the two divisions (W) remaining after the cutting off.

Figure 1:
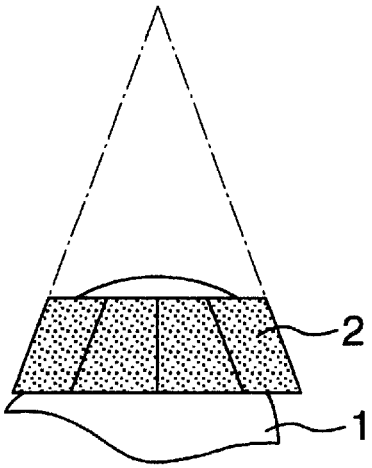
FIG. 1 (*a*) and FIG. 1 (*b*) are the side view and the plan, respectively, of an example of the composite helmet of this invention in which a helmet body is mounted or fixed with a hollow molding having an external, truncated, regularly octagonal pyramid shape.
Figure 1:
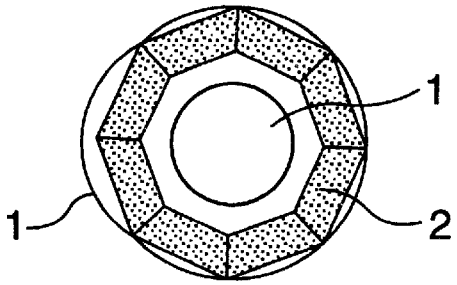

In the drawings, 1 refers to the helmet body; 2, 7, 10 and 13 to hollow moldings having an external, truncated pyramid shape; 3, 5 and 8 to hollow moldings having an external, truncated cone shape; 4, 6, 9, 11, 12, 15, 16, 18 and 23 to ceramic chips; 14, 17 and 24 to hollow moldings having an external, truncated pseudocone shape; 19 and 20 to divisions of a hollow molding having an external, truncated pyramid shape; and 21 and 22 to the outer layer and the internal layer, respectively, of a double-layer structure of a hollow molding having an external truncated pyramid shape, the layers being composed of diverse materials.

DETAILED DESCRIPTION OF THE INVENTION

In this invention, the above-mentioned hollow molding is a molded article having a hollow portion passing through the article from the top to the bottom, and it is preferable that the internal surface of this hollow molding has the same shape as the external shape of the helmet body. This hollow molding may have a double-layer or more multilayer structure, the layers being composed of the same material or diverse materials. In addition, it is preferable that in the hollow molding, the lengthwise direction corresponds to the front-and-rear direction of the helmet body and the width-wise direction to the right-and-left direction of the helmet body. Moreover, it is preferable that this hollow molding has a bisymmetric external shape. In addition, this hollow molding is preferably prepared by forming at least two vertical divisions of the said hollow molding and combining them into one hollow molding. Incidentally, the hollow molding having an external, truncated pyramid shape is usually of a truncated, quadrangular or more multiangular pyramid shape, preferably of a truncated, hexagonal or more multi-angular pyramid shape.

The composite helmet of this invention is preferably a composite helmet in which the hollow molding is detachably mounted or fixed on the helmet body.

The helmet body used in this invention may be any one generally called helmet, and preferably a safety helmet for construction work, a safety helmet for autobicycles, a safety helmet for school children, an impact-resistant bladeproof helmet, a bulletproof helmet or the like. The helmet body is composed of a plastic or a metal. As materials of the plastic, there can be used all materials which are employed for producing a helmet, and preferable are resins per se such as ABS, polycarbonate, polyethylene and the like; mixtures of the resins; materials composed of at least two layers; and materials composed of a resin and a reinforcing material, for example, FRP (general glass fiber-reinforced, nylon fiber-reinforced and polyester fiber-reinforced plastics), ACM and the like. These can be used alone or in the form of a composite. As the metal, the material is not limited, and preferable are titanium, titanium alloy, soft iron, high tensile steel, stainless steel, aluminum, duralumin and the like, and these can be used alone or in the form of an alloy or a composite.

In the above ACM, as the high-strength fiber, there are used those having a specific tensile strength of at least $10\times10^8$ cm as obtained by dividing tensile strength by density and a specific modulus of elasticity of at least $2.5\times10^8$ cm as obtained by dividing modulus of elasticity by density. Specifically, there are mentioned high-strength glass fiber, aramid fiber, aromatic polyester fiber, high-strength polyethylene fiber, high-strength nylon fiber, poly-p-phenylenebenzo-bisoxazole (popular name: PBO) and the like. General glass fiber, nylon fiber and polyester fiber and the like cannot be used as the high-strength fiber. When fibers having a specific tensile strength or a specific modulus of elasticity not lower than the above-mentioned values are used, the impact resistance of the helmet body becomes considerably good. On the other hand, when fibers having a specific tensile strength or specific modulus of elasticity lower than the above-mentioned values are used, the impact resistance of the helmet body is not necessarily sufficient, so that it is necessary to use, as the hollow molding or ceramic-fixed hollow molding, those having excellent impact resistance.

As the resin with which the high strength fibers are impregnated or coated in order to obtain the ACM, there can be used usually thermosetting resins such as phenolic resins, epoxy resins, polyurethane resins, unsaturated polyester resins, vinyl ester resins and polyimide resins and the like; thermoplastic resins, for example, polyolefins such as polyethylene, polypropylene and the like, polyamides, polyesters, polyvinyl acetate, polyetheretherketone, thermoplastic polyurethanes, thermoplastic elastomers and the like; and synthetic rubbers.

In order to obtain the ACM, when the thermo-setting resin is used, there can be used, for example, a compression molding method in which a prepreg is prepared by impregnating or coating the high-strength fibers with the thermosetting resin and plural sheets of this prepreg are piled one on another and then heated under pressure, and a hand lay-up method in which no prepreg is prepared. The resin content can be used in the range of 5 to 80% (by weight, the same applies hereinafter) and it is usually 5 to 50%. For excellent impact resistance, a resin content of 5 to 30% is preferred. When the thermoplastic resin is used, there is usually employed a compression molding method in which high-strength fibers are impregnated or coated with a thermoplastic resin solution, powder or dispersion to prepare a prepreg and plural sheets of this prepreg are piled one on another and then heated under pressure by use of a hot plate or a heated roll; or the like. In this case, the resin content is in the range of 5 to 80% and usually 5 to 50%. For obtaining excellent impact resistance, a resin content of 5 to 30% is preferred. When the resin content is less than 5%, it is difficult to prepare the prepreg, and when the resin content exceeds 80%, it is also difficult to prepare the prepreg and the impact resistance is deteriorated.

As the hollow molding, there is used a metal or a molding composed of FRP or ACM comprising the thermosetting or thermoplastic resin or composed of the resin per se, and it is preferable that they have a high surface hardness, a high mechanical strength (including impact strength), weather resistance and a light weight. The thermosetting resin includes phenolic resins, epoxy resins, unsaturated polyester resins, vinyl ester resins, urethane resins and the like; and the thermo-plastic resin includes polycarbonate resins, acrylic resins, ABS resins, polyethylene resins, polypropylene resins and the like. These resins can be used alone or in the form of a composite. As the fibers and the resins used in FRP and ACM, there are generally used those which are employed in the above helmet body. Moreover, as the metal, similarly, the materials which are employed in the above helmet body are generally used.

In the composite helmet of this invention, the hollow molding to be mounted or fixed on the outer surface of the helmet body has preferably a shape wherein at least two kinds of starting hollow moldings having different, external, truncated pyramid or cone shapes are put one on another and integrally bonded so as to make the integrated boundary surface smooth and make the external shape of the resulting hollow molding similar to the external shape of the helmet body.

Moreover, it is preferable that such a hollow molding has an external, truncated, bisymmetric, polygonal pyramid or pseudocone shape formed by cutting off a part of the starting hollow molding having an external, truncated polygonal pyramid or cone shape vertically to the base of the pyramid or cone in a certain width along the center line of the base so that the center line comes to the center of the width and integrally bonding the two divisions remaining after the cutting off so as to make the external shape of the resulting hollow molding much more similar to the external shape of the helmet body.

By allowing the hollow moldings to have the above-mentioned shapes, or by combining these hollow moldings, the appearance of the molding becomes extremely similar to the shape of the helmet body, the thickness of the molding becomes relatively uniform and the unnecessarily thick-wall portions become few, so that the necessary impact resistance can be secured and the weight-saving is achieved.

Furthermore, it is preferable to previously divide one hollow molding into at least two divisions, and combine the divisions to form a fresh hollow molding having an external, truncated pyramid or (pseudo)cone shape when the helmet body is mounted or fixed with this fresh hollow molding. In this case, the divisions are less in volume when not combined and hence convenient to carry. Usually, the divisions are detachably mounted or fixed on the helmet body; and, it is preferable that the contact portions of the adjacent divisions have an appropriate overlap structure.

In addition, if necessary, it is possible to allow the hollow molding to have a double-layer or more multilayer structure, the layers being composed of the same material or different materials. For example, by using a material excellent in impact strength and weather resistance as the outer layer and a material small in deformation at the time of impact and light in weight as the internal layer, there can be obtained a light weight helmet which is good in impact resistance and weather resistance as a whole.

Regarding the shape of the hollow molding, preferably the internal shape thereof is the same as the external shape of the helmet body. In this case, the helmet body can be fitted with the hollow molding without spaces, and accordingly, the impact resistance of the composite helmet is more improved and the stability when the hollow molding is mounted on the helmet body is good and the adaptability of the composite helmet is excellent.

The ceramics which are used in this invention are preferably those called fine ceramics and include alumina type (purity: 90 to 99.9), silicon nitride type, silicon carbide type, zirconia type and the like; however, they are not limited. Moreover, such ceramics may be used alone or in combination of two or more. Regarding the physical properties of the ceramics, preferably the Vickers hardness is 1,000 $kg/mm^2$ or more, the flexural strength is 30 $kgf/mm^2$ or more and the modulus of elasticity is $2.8\times10^4$ $kg/mm^2$ or more.

Figure 3:
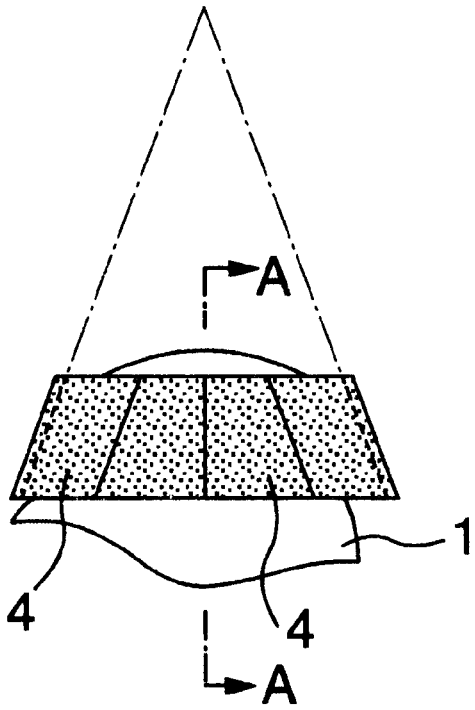
FIG. 3 (*a*), FIG. 3 (*b*) and FIG. 3 (*c*) are the side view, the A—A sectional view and the plan, respectively, of another example of the composite helmet of this invention in which eight ceramic chips are combined and fixed on the hollow molding having an external, truncated, regularly octagonal pyramid shape of the composite helmet shown in FIGS. 1 (*a*) and 1 (*b*).
Figure 3:
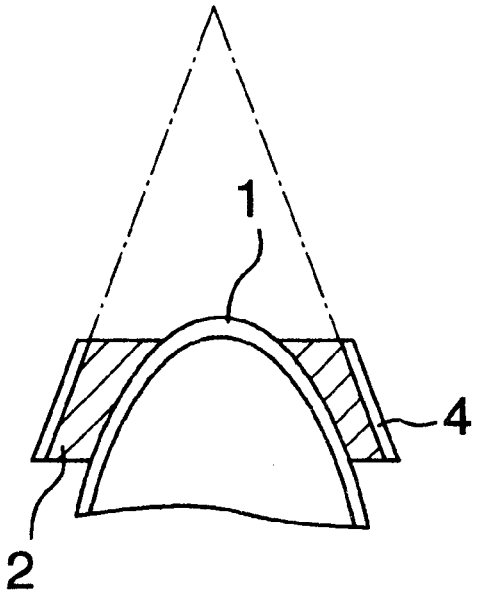
Figure 3:
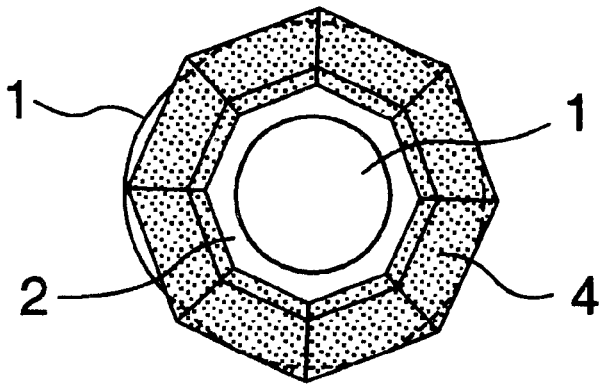
Figure 4:
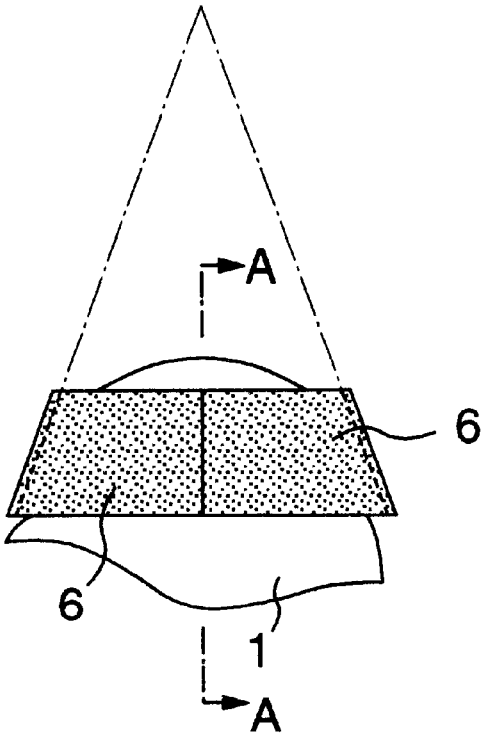
FIG. 4 (*a*), FIG. 4 (*b*) and FIG. 4 (*c*) are the side view, the A—A sectional view and the plan, respectively, of another example of the composite helmet of this invention in which four ceramic chips are fixed on the hollow molding having an external, truncated cone shape of the composite helmet shown in FIGS. 2 (*a*) and 2 (*b*).
Figure 4:
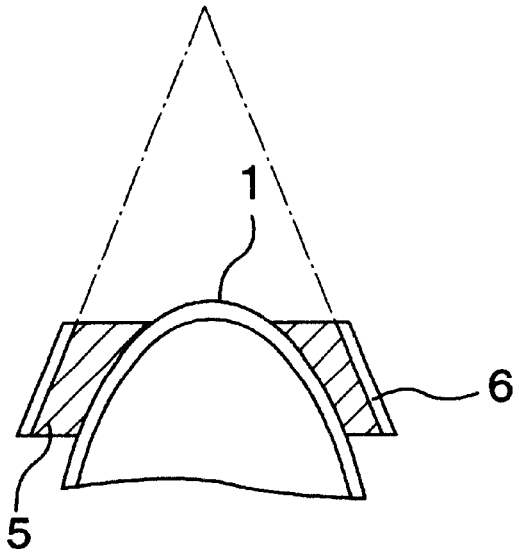
Figure 4:
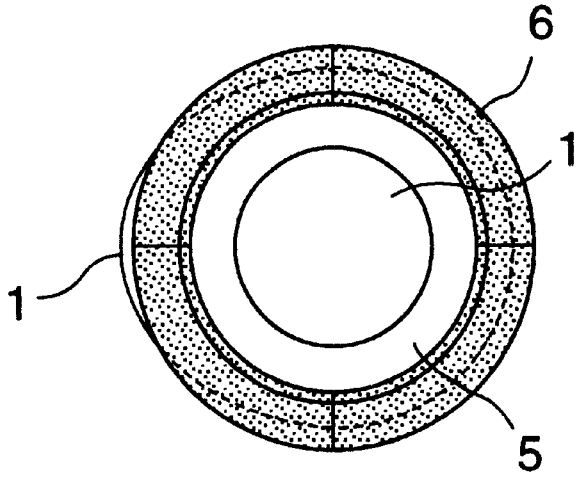

The shape of the ceramic chip is, for example, a flat trapezoidal plate shape in the case where eight ceramic chips can be closely fixed without spaces on the outside of the hollow molding having an external, truncated, octagonal pyramid shape (see FIG. 3) or a ¼ part of a truncated cone shape in the case where four ceramic chips can be closely fixed without spaces on the outside of a hollow molding having an external, truncated cone shape (see FIG. 4). Alternatively, in the case of a hollow molding formed by putting at least two kinds of hollow moldings having different, external, truncated pyramid or cone shapes one on another and integrally bonding them so as to make the integrated boundary surface smooth and make the external shape of the resulting hollow molding similar to the external shape of the helmet body (see FIG. 5 and FIG. 6), the ceramic chips to be fixed on the hollow molding may be of a trapezoidal or triangular shape. Thus, the ceramic chips may be of a triangular shape, a quadrangular shape (square, rectangle, or trapezoid) or a curved trapezoidal shape, and various shapes can be used as far as they enable the ceramic chips to be fixed on the outside of the hollow molding having an external, truncated pyramid or (pseudo)cone shape without causing spaces between the hollow molding and the ceramic chips or between the adjacent ceramic chips, and are not limited.

The ceramic-fixed hollow molding is used in the case where the head is protected against an object coming flying at a high speed which has a very strong impact force. When the object coming flying does not have so strong impact force, the ceramic-free hollow molding can be used. When the composite helmet is used only in the latter case, there may be used not only a hollow molding having an external, truncated pyramid or (pseudo)cone shape but also a hollow molding whose external shape is the so-called helmet shape which is substantially resemble to the external shape of the helmet body but cut off horizontally at the top.

The mounting or fixing of the hollow molding obtained by the above-mentioned methods on the helmet body is carried out preferably by a method in which the internal surface of the hollow molding is bonded to the outer surface of the helmet body with an adhesive of the resin per se used in the hollow molding, a synthetic rubber, an epoxy resin, a urethane resin or the like or a pressure sensitive adhesive tape such as a double bond tape. In some cases, the two can be joined mechanically with volts, rivets or the like. In order to most simply effect the fixing and detaching, there are also used a method of merely nesting the two, a method in which a magnet or a magic tape is bonded to each of the hollow molding and the helmet body and the two are joined with the magnets or the magic tapes, and the like.

As a method for fixing the ceramic chips on the hollow molding, preferable are, as in the above case, a method in which the internal surface of the ceramic chip is bonded to the outer surface of the hollow molding with an adhesive of the resin per se used in the hollow molding, a synthetic rubber, an epoxy resin, a urethane resin or the like or by a pressure-sensitive adhesive tape such as a double bond tape. In some cases, a mechanical joining with a volt, a rivet or the like can be used and there is also used a method in which a magnet or a magic tape is fixed on each of the ceramic chip and the hollow molding and the two are joined with the magnets or the magic tapes; or the like.

In the case of the composite helmet thus obtained in which the helmet body is mounted or fixed with the ceramic-fixed hollow molding, when an object having a large impact force or an object coming flying at a very high speed collides with the helmet, the ceramic is first broken and then the hollow molding is deformed or partially broken, after which the colliding object which has rapidly lost its energy and the fragments of the ceramic and the hollow molding reach the helmet body. Therefore, the direct impact to the helmet body is small, the bulge of the helmet inside by the impact is small and the damage of the head can be made little.

In the case of the helmet body mounted or fixed with the ceramic-free hollow molding, when an object having not so large impact force or an object coming flying at a high speed collides with the composite helmet, the hollow molding is first broken and the colliding object which has rapidly lost its energy and the fragments of the hollow molding reach the helmet body, so that the direct impact to the helmet body is small as mentioned above, the bulge of the helmet body inside is small and the damage of the head can be made little.

Furthermore, since the helmet body can be mounted or fixed detachably or undetachably with the hollow molding or the ceramic-fixed hollow molding, the weight load applied to the head can be made small by mounting the hollow molding when required and detaching the hollow molding when not required, whereby the adaptability of the helmet during use can be greatly improved.

In addition, when the external shape of the hollow molding is made bisymmetric, the balance of the hollow molding mounted on the helmet body is good and this is important in respect of function and adaptability.

DESCRIPTION OF PREFERRED EMBODIMENTS

Specific examples of the composite helmet of this invention are explained below based on the drawings.

FIGS. 1 (*a*) and 1 (*b*) show the case where the helmet body is mounted or fixed with a hollow molding having an external, truncated pyramid shape. 1 refers to the helmet body and 2 to the hollow molding having an external, truncated, regularly octagonal pyramid shape.

Figure 2:
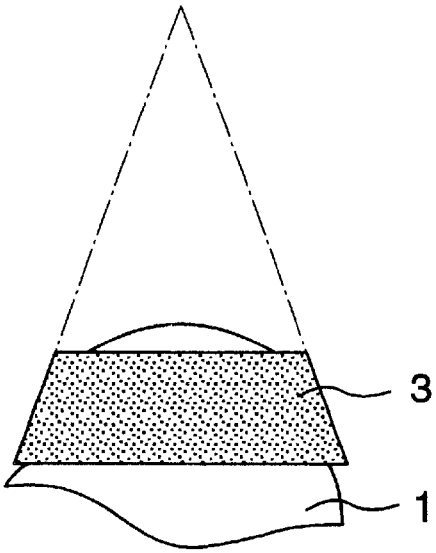
FIG. 2 (*a*) and FIG. 2 (*b*) are the side view and the plan, respectively, of another example of the composite helmet of this invention in which a helmet body is mounted or fixed with a hollow molding having an external, truncated cone shape.
Figure 2:
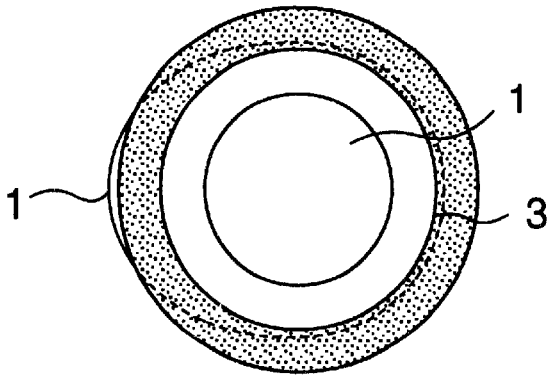

FIGS. 2 (*a*) and 2 (*b*) show the case where the helmet body is mounted or fixed with a hollow molding having an external, truncated cone shape. 1 refers to the helmet body and 3 to the hollow molding having an external, truncated cone shape.

FIGS. 3 (*a*), 3 (*b*) and 3 (*c*) show the case where eight ceramic chips having a trapezoidal shape are combined and fixed on the whole surface of the hollow molding having an external, truncated pyramid shape shown in FIGS. 1 (*a*) and 1 (*b*). 1 refers to the helmet body, 2 to the hollow molding having an external, truncated regularly octagonal pyramid shape and 4 to the ceramic chips having a trapezoidal shape which are combined.

FIGS. 4 (*a*), 4 (*b*) and 4 (*c*) show the case where four ceramic chips are combined and fixed on the whole surface of a hollow molding having an external, truncated cone shape as shown in FIGS. 2 (*a*) and 2 (*b*). 1 refers to the helmet body, 5 to the hollow molding having an external, truncated cone shape and 6 to the ceramic chips which are combined.

Figure 5:
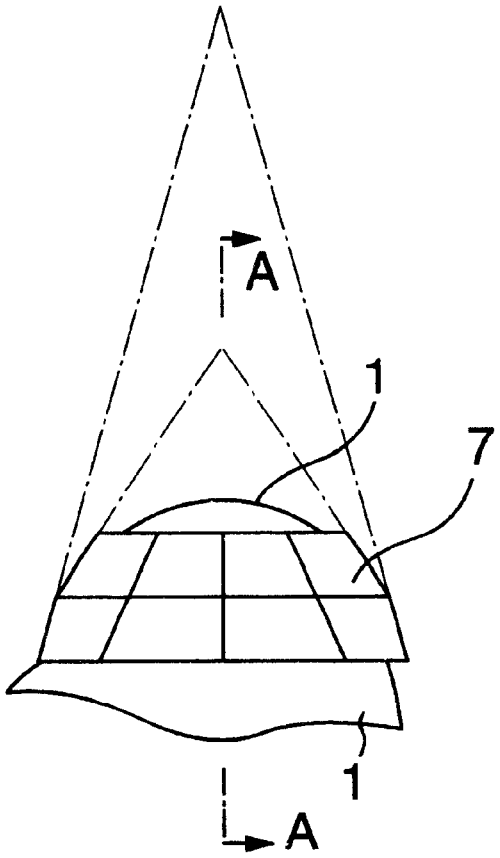
FIG. 5 (*a*), FIG. 5 (*b*) and FIG. 5 (*c*) are the side view, the A—A sectional view and the plan, respectively, of another example of the composite helmet of this invention in which a helmet body is mounted or fixed with a hollow molding formed by putting two starting hollow moldings having different, external, truncated pyramid shapes one on the other and integrally bonding them so as to make the external shape of the resulting hollow molding similar to the external shape of the helmet body.
Figure 5:
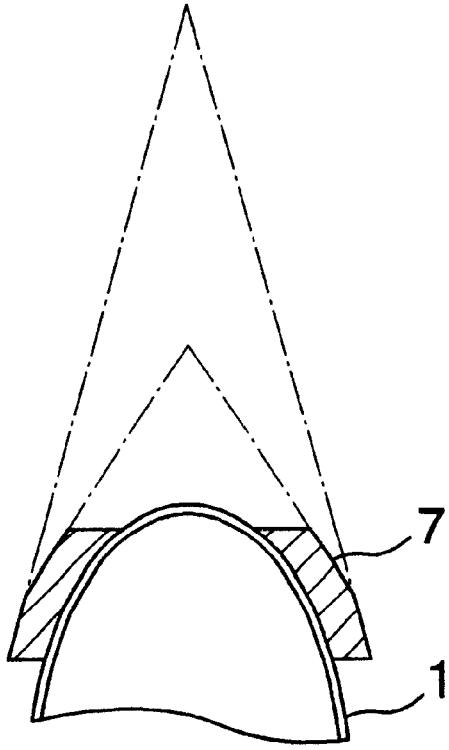
Figure 5:
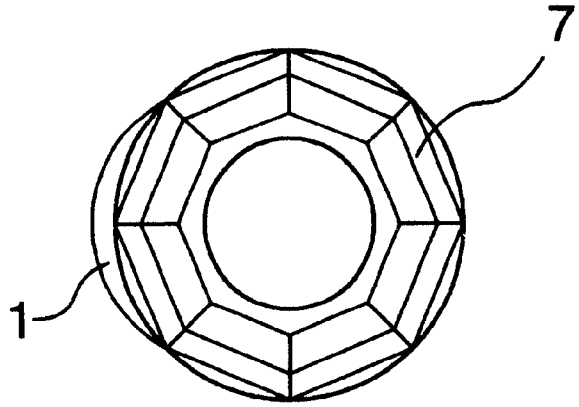

FIGS. 5 (*a*), 5 (*b*) and 5 (*c*) show the case where a helmet body is mounted or fixed with a hollow molding prepared by putting two kinds of starting hollow moldings having different, external, truncated, octagonal pyramid shapes one on the other and integrally bonding them so as to make the integrated boundary surface smooth and make the external shape of the resulting hollow molding similar to the external shape of the helmet body. 1 refers to the helmet body and 7 to the hollow molding formed by integrally bonding the two kinds of starting hollow moldings having different, external, truncated, octagonal pyramid shapes.

Figure 6:
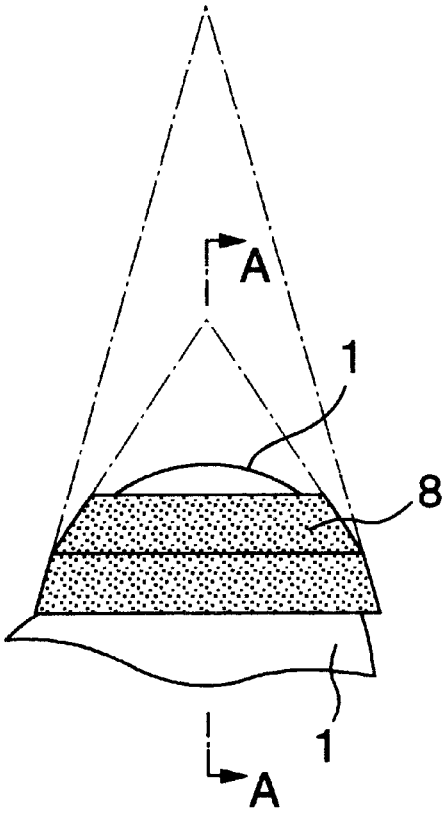
FIG. 6 (*a*), FIG. 6 (*b*) and FIG. 6 (*c*) are the side view, the A—A sectional view and the plan, respectively, of another example of the composite helmet of this invention in which a helmet body is mounted or fixed with a hollow molding formed by putting two starting hollow moldings having different, external, truncated cone shapes one on the other and integrally bonding them so as to make the external shape of the resulting hollow molding similar to the external shape of the helmet body.
Figure 6:
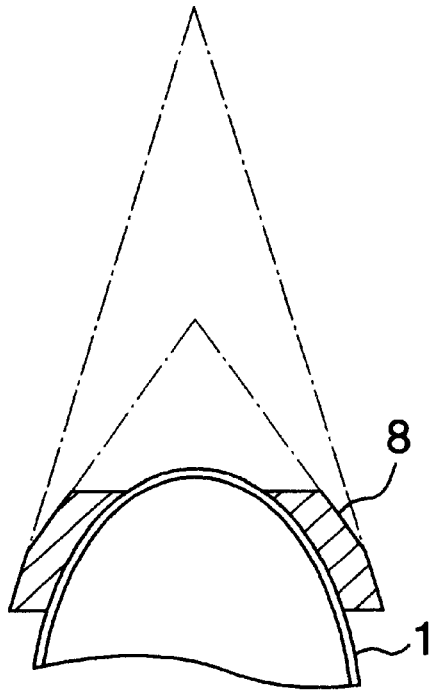
Figure 6:
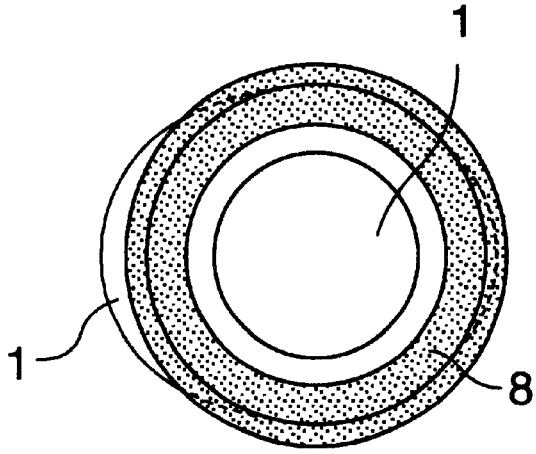

FIGS. 6 (*a*), 6 (*b*) and 6 (*c*) show the case where the helmet body is mounted or fixed with a hollow molding prepared by putting two kinds of starting hollow moldings having different, external, truncated cone shapes one on the other and integrally bonding them so as to make the external shape of the resulting hollow molding similar to the external shape of the helmet body. 1 refers to the helmet body and 8 to the hollow molding prepared by integrally bonding two kinds of hollow moldings having different, external, truncated cone shapes.

Figure 7:
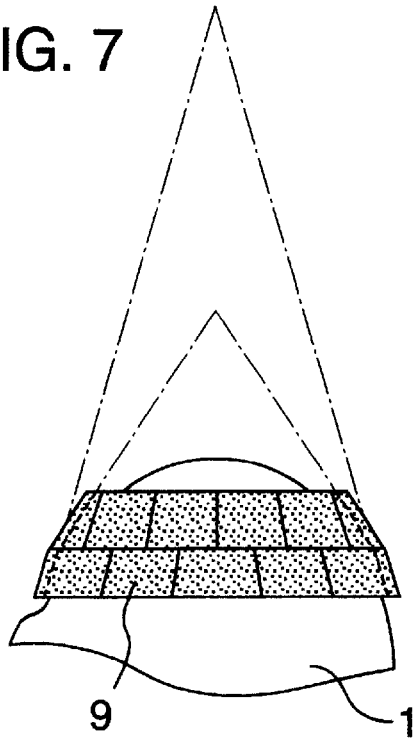
FIG. 7 is the side view of another example of the composite helmet of this invention in which two kinds of ceramic chips are combined in a zigzag fashion and fixed on the hollow molding of the composite helmet shown in FIGS. 6 (*a*), 6 (*b*) and 6 (*c*).

FIG. 7 shows the case where two kinds of ceramic chips are combined so that the upper ceramic chips and the lower ceramic chips are arranged in a zigzag fashion and fixed on the whole surface of the hollow molding of the composite helmet shown in FIGS. 6 (*a*), 6 (*b*) and 6 (*c*). 1 refers to the helmet body and 9 to the ceramic chips which are combined.

Figure 8:
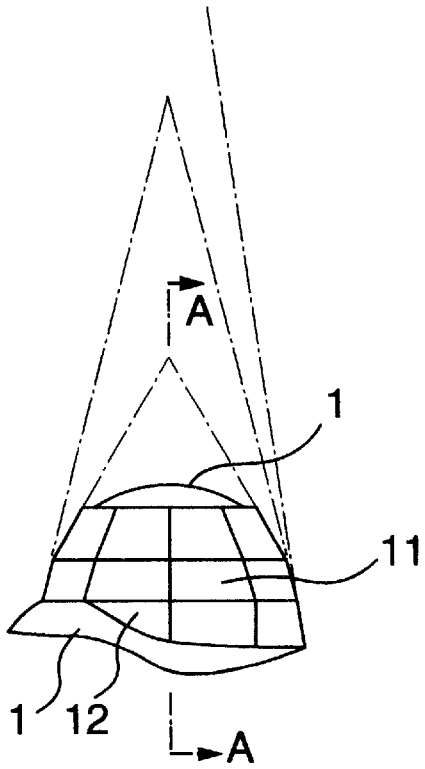
FIG. 8 (*a*) and FIG. 8 (*b*) are the side view and the A—A sectional view, respectively, of another example of the composite helmet of this invention in which a helmet body is mounted or fixed with a hollow molding formed by putting three kinds of starting hollow moldings having different, external, truncated pyramid shapes one on another and integrally bonding them so as to make the external shape of the resulting hollow molding similar to the external shape of the helmet body and further ceramic chips having a trapezoidal shape and a triangular shape are fixed on the hollow molding.
Figure 8:
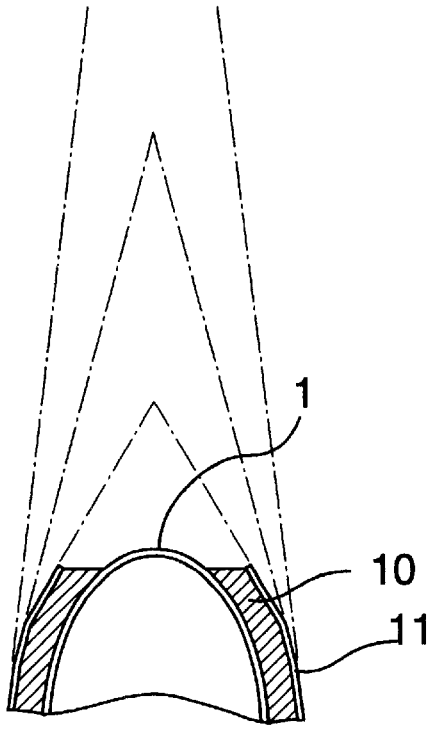

FIGS. 8 (*a*) and 8 (*b*) show the case where three kinds of ceramic chips having different trapezoidal shapes and one kind of ceramic chip having a triangular shape are fixed on the whole surface of a hollow molding prepared by putting three kinds of starting hollow moldings having different, external, truncated pyramid shapes one on another and integrally bonding them and the helmet body is mounted or fixed with the resulting ceramic chip-fixed hollow molding. 1 refers to the helmet body, 10 to the hollow molding prepared by integrally bonding the three kinds of hollow moldings having different, external, truncated pyramid shapes, 11 to the three kinds of ceramic chips having different trapezoidal shapes and 12 to the ceramic chip having a triangular shape.

Figure 9:
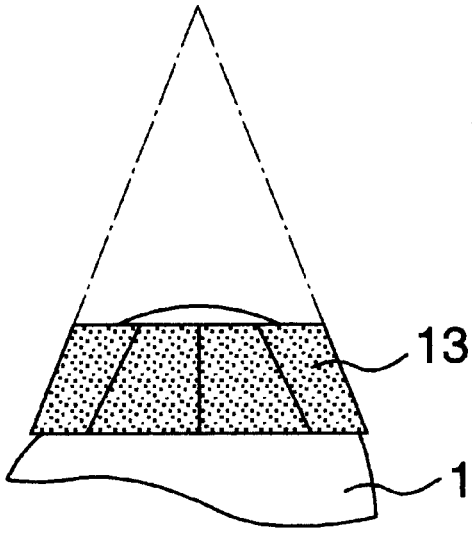
FIG. 9 (*a*) and FIG. 9 (*b*) are the side view and the plan, respectively, of another example of the composite helmet of this invention in which a helmet body is mounted or fixed with a hollow molding having an external, truncated, bisymmetric, octagonal pyramid shape.
Figure 9:
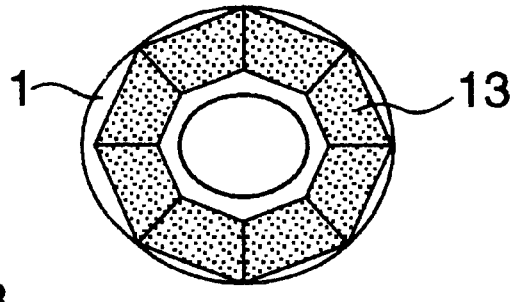
Figure 9:
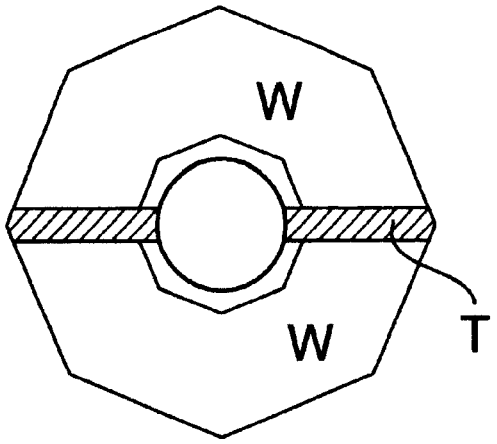
Figure 9:
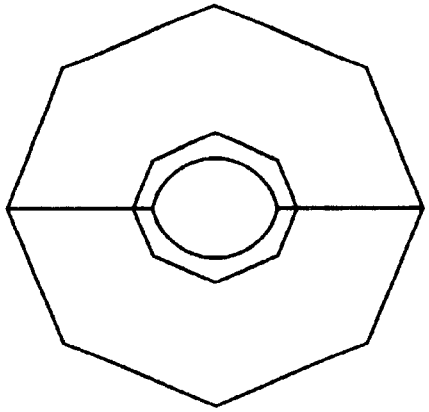

FIGS. 9 (*a*), 9 (*b*), 9 (*c*) and 9 (*d*) show the case where the helmet body is mounted or fixed with a hollow molding having an external, truncated, bisymmetric, octagonal pyramid shape prepared by cutting off a part of the starting hollow molding having an external, truncated octagonal pyramid shape vertically to the base of the pyramid shape in a certain width along the center line of the base so that the center line comes to the center of the width and integrally bonding the two divisions remaining after the cutting off so as to make the external shape of the resulting hollow molding extremely similar to the external shape of the helmet body. FIG. 9 (*a*) is the side view, FIG. 9 (*b*) is the plan, FIG. 9 (*c*) is the plan showing that a part of the starting hollow molding having an external, truncated, regularly octagonal pyramid shape is vertically cut off at center in a certain width (T), and FIG. 9 (*d*) is the plan of the hollow molding having an external, truncated, bisymmetric, octagonal pyramid shape formed by bonding the two divisions (W) remaining after the cutting off. 1 refers to the helmet body and 13 to the hollow molding having an external, truncated, bisymmetric, octagonal pyramid shape.

Figure 10:
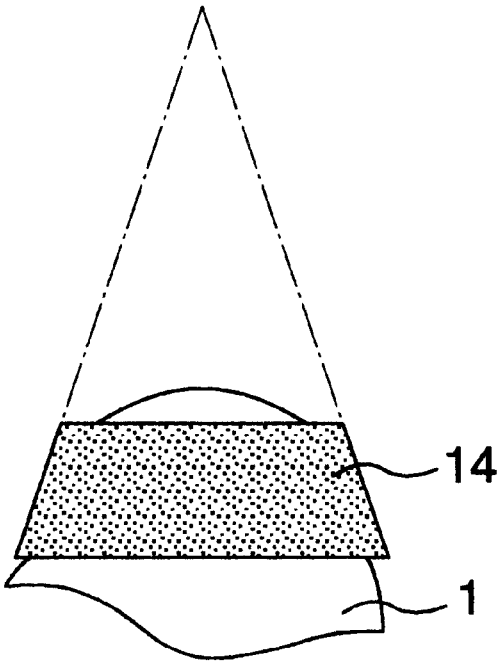
FIG. 10 (*a*) and FIG. 10 (*b*) are the side view and the plan, respectively, of another example of the composite helmet of this invention in which a helmet body is mounted or fixed with a hollow molding having an external, truncated, bisymmetric pseudocone shape.
Figure 10:
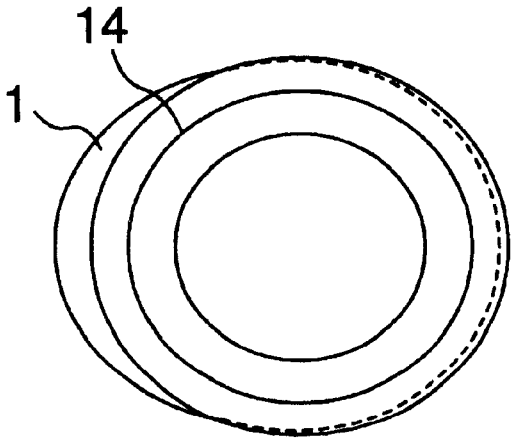
Figure 10:
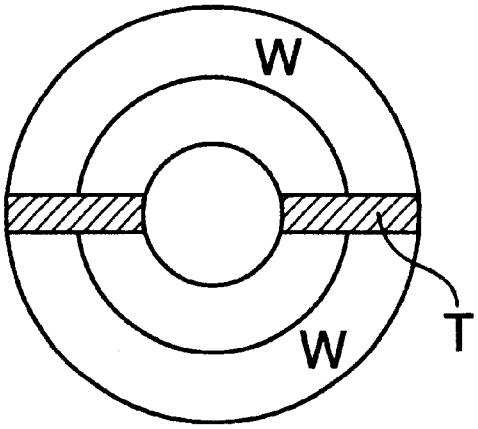
Figure 10:
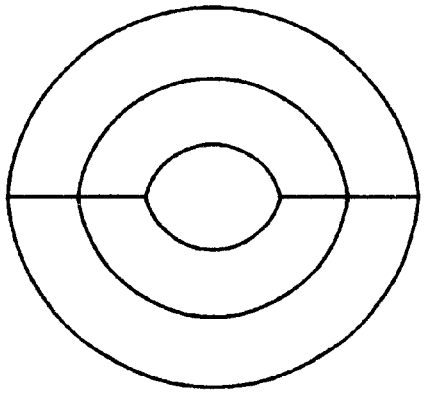

FIGS. 10 (*a*), 10 (*b*), 10 (*c*) and 10 (*d*) show the case where the helmet body is mounted or fixed with a hollow molding having an external, truncated, bisymmetric pseudocone shape formed by cutting off a part of the starting hollow molding having an external, truncated cone shape vertically to the base of the cone in a certain width along the center line of the base so that the center line comes to the center of the width and integrally bonding the two divisions remaining after the cutting off so as to make the external shape of the resulting hollow molding extremely similar to the external shape of the helmet body. FIG. 10 (*a*) is the side view, FIG. 10 (*b*) is the plan, FIG. 10 (*c*) is the plan showing that a part of the starting hollow molding having an external, truncated cone shape is cut off vertically to the base of the cone in a certain width (T), and FIG. 10 (*d*) is the plan of the hollow molding having an external, truncated, bisymmetric pseudocone shape formed by integrally bonding the two divisions (W) remaining after the cutting off. 1 refers to the helmet body and 14 to the hollow molding having an external, truncated, bisymmetric pseudocone shape.

Figure 11:
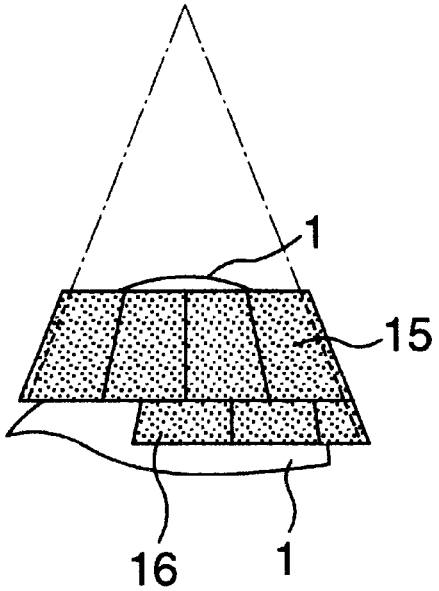
FIG. 11 is the side view of an example of the composite helmet of this invention in which a helmet body is mounted or fixed with a hollow molding on which ceramic chips are combined and fixed in a zigzag fashion, said hollow molding having been formed by putting two kinds of starting hollow moldings having different, external, truncated cone shapes one on the other and integrally bonding them.

FIG. 11 shows the case where the helmet body is mounted or fixed with a ceramic-fixed hollow molding prepared by putting two kinds of starting hollow moldings having different, external, truncated cone shapes one on the other, integrally bonding them and then fixing, on the resulting hollow molding, two kinds of ceramic chips combined in a zigzag fashion. 1 refers to the helmet body, 15 and 16 to the two kinds of ceramic chips having different shapes.

Figure 12:
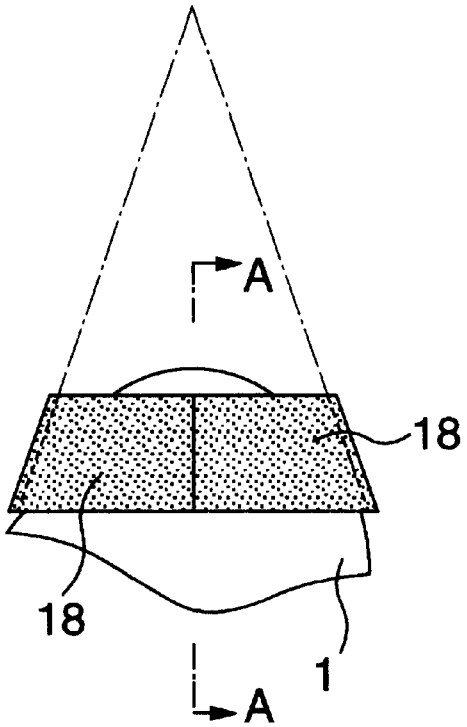
FIG. 12 (*a*) and FIG. 12 (*b*) are the side view and the A—A sectional view, respectively, of another example of the composite helmet of this invention in which four ceramic chips having the same shape are combined and fixed on the hollow molding having an external, truncated, bisymmetric pseudocone shape of the composite helmet shown in FIGS. 10 (*a*) and 10 (*b*).
Figure 12:
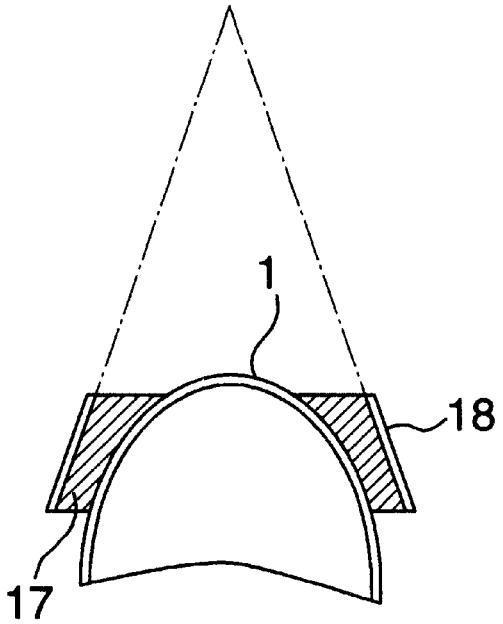

FIGS. 12 (*a*) and 12 (*b*) show the case where four ceramic chips are combined and fixed on the whole surface of the hollow molding having an external, truncated pseudocone shape of the composite helmet shown in FIGS. 10 (*a*) and 10 (*b*). FIG. 12 (*a*) is the side view and FIG. 12 (*b*) is the A—A sectional view. 1 refers to the helmet body, 17 to the hollow molding having an external, truncated, pseudocone shape and 18 to the four ceramic chips which are combined.

Figure 13:
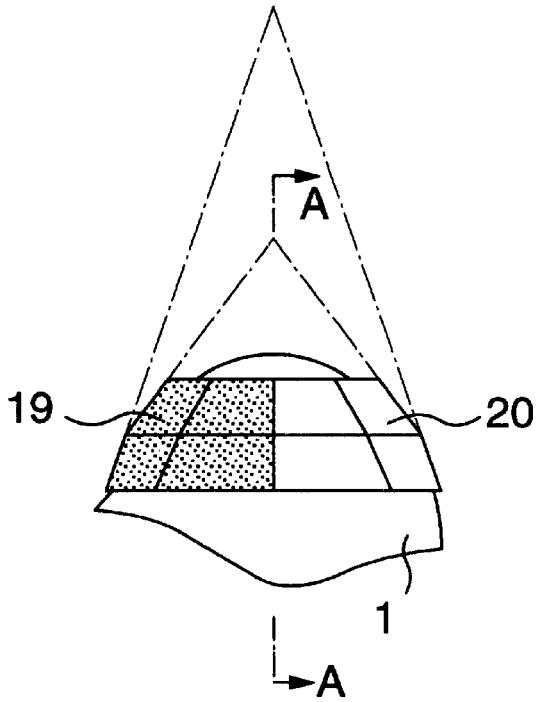
FIG. 13 (*a*), FIG. 13 (*b*) and FIG. 13 (*c*) are the side view, the A—A sectional view and the plan, respectively, of another example of the composite helmet of this invention in which a helmet body is mounted or fixed with a hollow molding formed by putting two kinds of starting hollow moldings having different, external, truncated bisymmetric octagonal pyramid shapes similar to the shape shown in FIGS. 9 (*a*) and 9 (*b*), each of the moldings having been vertically divided into two halves, one on the other and integrally bonding them so as to make the integrated boundary surface smooth and make the external shape of the resulting hollow molding extremely similar to the external shape of the helmet body.
Figure 13:
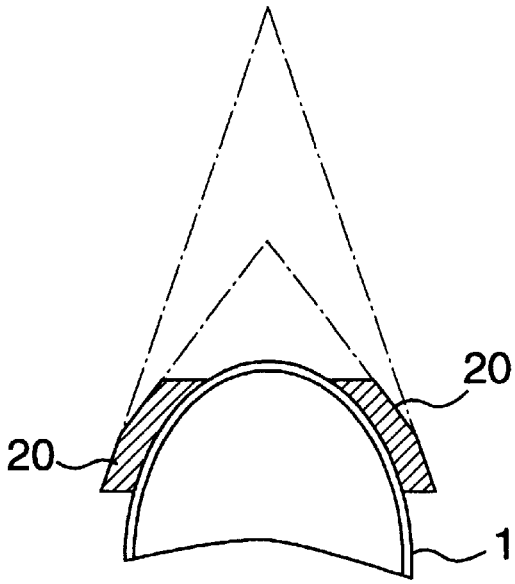
Figure 13:
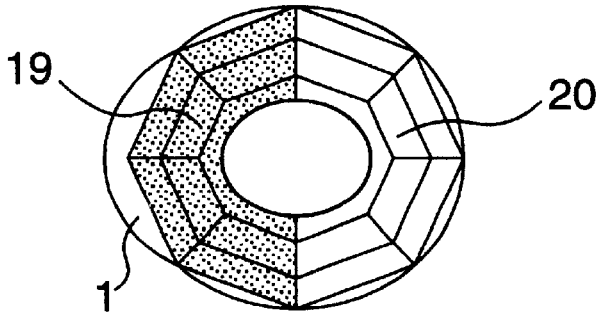

FIGS. 13 (*a*), 13 (*b*) and 13 (*c*) show the case where the helmet body is mounted or fixed with a hollow molding formed by putting two kinds of starting hollow moldings having different, external, truncated, bisymmetric octagonal pyramid shapes similar to that shown in FIGS. 9 (*a*) and 9 (*b*), each of the moldings having been vertically divided in two halves, one on the other and integrally bonding them so as to make the integrated boundary surface smooth and make the external shape of the resulting hollow molding extremely similar to the external shape of the helmet body. FIG. 13 (*a*) is the side view, FIG. 13 (*b*) is the A—A sectional view and FIG. 13 (*c*) is the plan. 1 refers to the helmet body and 19 and 20 refer to the halves of the hollow molding having an external, truncated, bisymmetric octagonal pyramid shape.

Figure 14:
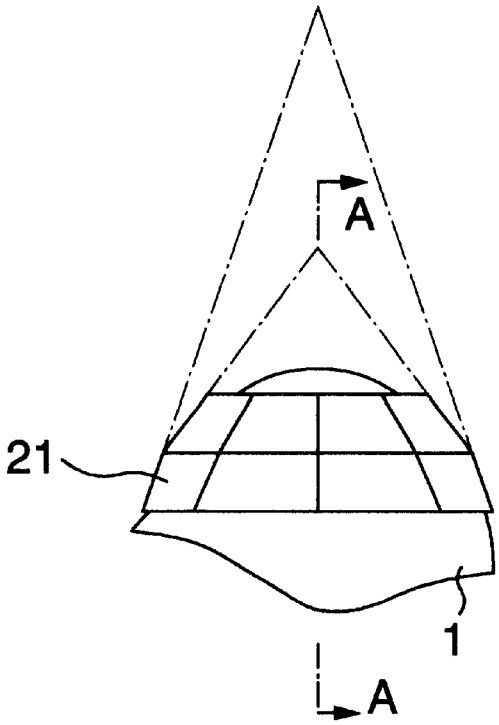
FIG. 14 (*a*), FIG. 14 (*b*) and FIG. 14 (*c*) are the side view, the A—A sectional view and the plan, respectively, of another example of the composite helmet of this invention in which a helmet body is mounted or fixed with a hollow molding formed by putting two kinds of starting hollow moldings having different, external, truncated, bisymmetric octagonal pyramid shapes similar to the shape shown in FIGS. 9 (*a*) and 9 (*b*), each of the hollow moldings having a double-layer structure, the layers of which are composed of different materials, one on the other and integrally bonding them so as to make the integrated boundary surface smooth and make the external shape of the resulting hollow molding more similar to the external shape of the helmet body.
Figure 14:
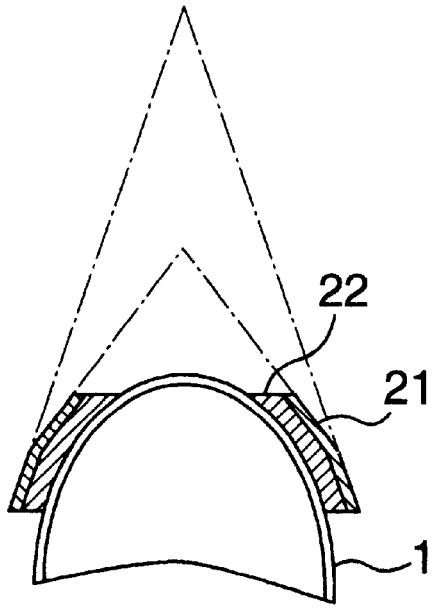
Figure 14:
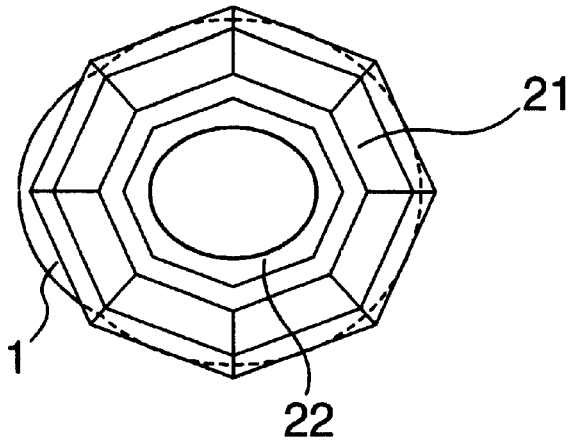

FIGS. 14 (*a*), 14 (*b*) and 14 (*c*) show the case where the helmet body is fitted with a hollow molding prepared by putting two starting double-layer hollow moldings having different, external, truncated, bisymmetric octagonal pyramid shapes, the layers thereof being composed of different materials, one on the other and integrally bonding them so as to make the integrated boundary surface smooth and make the external shape of the resulting hollow molding similar to the external shape of the helmet body. FIG. 14 (*a*) is the side view, FIG. 14 (*b*) is the A—A sectional view and FIG. 14 (*c*) is the plan. 1 refers to the helmet body, 21 to the outer layer of the double-layer hollow molding and 22 to the inner layer of the double-layer hollow molding.

Figure 15:
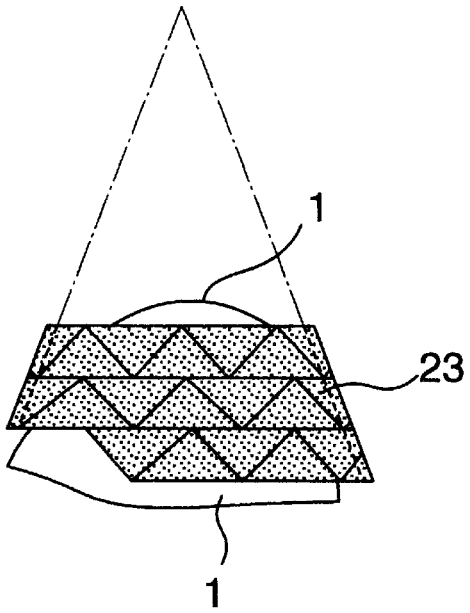
FIG. 15 is the side view of another example of the composite helmet of this invention in which ceramic chips having a triangular shape are combined in three stages and fixed on the hollow molding having an external truncated bisymmetric pseudocone shape of the composite helmet shown in FIGS. 10 (*a*) and 10 (*b*).

FIG. 15 shows the case where the helmet body is mounted or fixed with a hollow molding having an external, truncated pseudocone shape similar to the shape shown in FIGS. 10 (*a*) and 10 (*b*), on the whole surface of which ceramic chips having a curved triangular shape combined in three stages are fixed. 1 refers to the helmet body and 23 to ceramic chips having a curved triangular shape which are combined.

Figure 16:
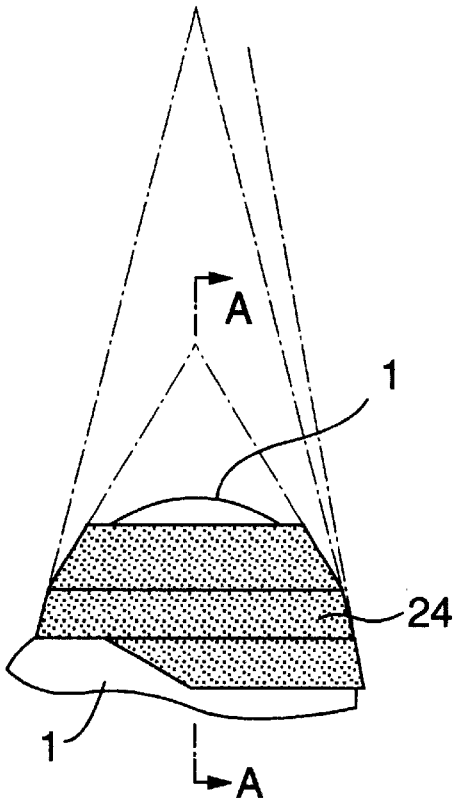
FIG. 16 (*a*) and FIG. 16 (*b*) are the side view and the A—A sectional view, respectively, of another example of the composite helmet of this invention in which a helmet body is mounted or fixed with a hollow molding formed by putting three kinds of starting hollow moldings having different, external, truncated pseudocone shapes similar to the shape shown in FIGS. 10 (*a*) and 10 (*b*), one on another and integrally bonding them.
Figure 16:
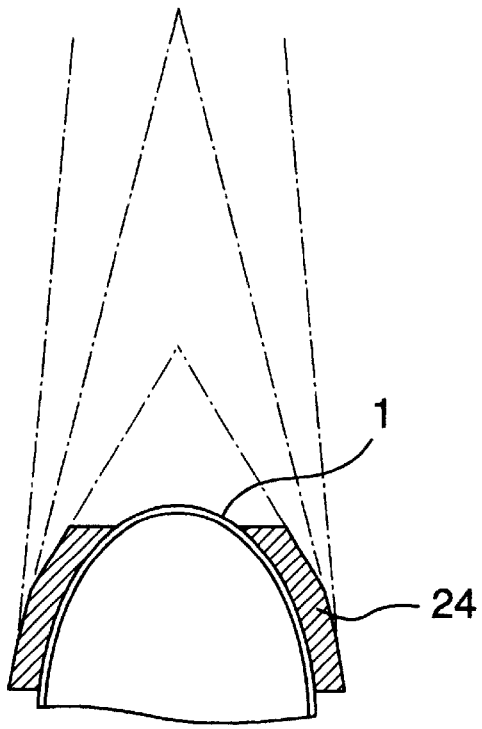

FIGS. 16 (*a*) and 16 (*b*) show the case where a helmet body is mounted or fixed with a hollow molding prepared by putting three kinds of starting hollow moldings having different, external, truncated pseudocone shapes one on another and integrally bonding them. FIG. 16 (*a*) is the side view and FIG. 16 (*b*) is the A—A sectional view. 1 refers to the helmet body and 24 to the hollow molding having an external, truncated pseudocone shape.

As clear from the above description, the composite helmet of this invention has excellent impact resistance to an object falling down from a high place or an object coming flying at a high speed and at the same time the hollow molding or ceramic-fixed hollow molding is light in weight and can be made detachable, whereby the adaptability of the composite helmet can be made better. Moreover, when the outer surface of a helmet body is fitted with a hollow molding having an external, truncated, bisymmetric pyramid or pseudocone shape prepared by cutting off a port of the starting molding material having an external, truncated pyramid or cone shape vertically to the base of the truncated pyramid or cone in a certain width along the center line of the base so that the center line comes to the center of the width and integrally bonding the two divisions remaining after the cutting off so as to make the external shape of the resulting hollow molding extremely similar to the external shape of the helmet body, the external shape of the molding becomes very close to the external shape of the helmet body and the thickness of the molding can be uniformalized. Hence, the weight-saving of the composite helmet can be achieved.

Ceramic chips are made usable only by forming them into several kinds of flat plates or curved plates, so that the composite helmet of this invention is much less expensive than the case where ceramic chips are fixed directly on the helmet body. In addition, when ceramic chips are fixed on a hollow molding, the workability is good because the surface of the ceramic chip is the same plane or curved surface as that of the hollow molding, and further, it is possible to closely adhere the ceramic chips to the hollow molding.

What is claimed is:

1. A composite helmet which comprises:

a helmet body having an external surface; and a hollow molding having an external, truncated pyramid shape attached to the external surface of the helmet body, wherein said pyramid shape is truncated at a point opposite to and farthest from a base of said pyramid shape.

2. The composite helmet according to claim 1, wherein ceramic chips are fixed on at least a part of the surface of the hollow molding.

3. The composite helmet according to claim 1, wherein the hollow molding is prepared by putting at least two kinds of hollow moldings having different, external, truncated pyramid shapes one on another and integrally bonding them so as to make the integrated boundary surface smooth and make the external shape of the resulting hollow molding similar to the external shape of the helmet body.

4. The composite helmet according to claim 3, wherein ceramic chips are fixed on at least a part of the surface of the hollow molding.

5. The composite helmet according to claim 1, wherein the hollow molding attached to the helmet body is a hollow molding having an external, truncated, bisymmetric pyramid shape prepared by cutting off a part of the hollow molding having an external, truncated pyramid shape vertically to the base of the pyramid in a certain width along the center line of the base so that the center line comes to the center of the width and integrally bonding the two divisions remaining after the cutting off so as to make the external shape of the resulting hollow molding similar to the external shape of the helmet body.

6. The composite helmet according to claim 5, wherein the hollow molding attached to the helmet body is a hollow molding prepared by putting at least two kinds of hollow moldings having different, external, truncated bisymmetric pyramid shapes one on another and integrally bonding them so as to make the integrated boundary surface smooth and make the external shape of the resulting hollow molding similar to the external shape of the helmet body.

7. The composite helmet according to claim 6, wherein the hollow molding attached to the helmet body has a multilayer structure.

8. The composite helmet according to claim 6, wherein the hollow molding is a combination of at least two divisions of the hollow molding.

9. The composite helmet according to claim 5, wherein ceramic chips are fixed on at least a part of the surface of the hollow molding.

10. The composite helmet according to claim 6, wherein ceramic chips are fixed on at least a part of the surface of the hollow molding.

11. The composite helmet according to claim 1, wherein the hollow molding attached to the helmet body has a multilayer structure.

12. The composite helmet according to claim 11, wherein the layers are composed of the same materials.

13. The composite helmet according to claim 11, wherein the layers are composed of different materials.

14. The composite helmet according to claim 11, wherein ceramic chips are fixed on at least a part of the surface of the hollow molding.

15. The composite helmet according to claim 1, wherein the hollow molding is a combination of at least two divisions of the hollow molding.

16. The composite helmet according to claim 15, wherein ceramic chips are fixed on at least a part of the surface of the hollow molding.

17. The composite helmet according to claim 1, wherein the lengthwise direction of the hollow molding corresponds to the front-and-rear direction of the helmet body and the widthwise direction of the hollow molding corresponds to the right-and-left direction of the helmet body.

18. The composite helmet according to claim 17, wherein ceramic chips are fixed on at least a part of the surface of the hollow molding.

19. The composite helmet according to claim 1, wherein the hollow molding has a bisymmetric shape.

20. The composite helmet according to claim 19, wherein the lengthwise direction of the hollow molding corresponds to the front-and-rear direction of the helmet body and the widthwise direction of the hollow molding corresponds to the right-and-left direction of the helmet body.

21. The composite helmet according to claim 19, wherein ceramic chips are fixed on at least a part of the surface of the hollow molding.

22. The composite helmet according to claim 20, wherein ceramic chips are fixed on at least a part of the surface of the hollow molding.

23. The composite helmet according to claim 1, wherein the internal surface of the hollow molding has the same shape as the external shape of the helmet body.

24. The composite helmet according to claim 23, wherein ceramic chips are fixed on at least a part of the surface of the hollow molding.

25. A composite helmet according to claim 1, wherein the helmet body is composed of plastic.

26. A composite helmet according to claim 1, wherein the helmet body is composed of metal.

27. A composite helmet according to claim 1, wherein the hollow molding is attached detachably to the external surface of the helmet body.

28. A composite helmet according to claim 1, wherein the hollow molding is attached undetachably to the external surface of the helmet body.

29. A composite helmet which comprises:

a helmet body having an external surface; and a hollow molding having an external, truncated cone shape attached to the external surface of the helmet body, wherein said cone shape is truncated at a point opposite to and farthest from a base of said cone shape.

30. A composite helmet according to claim 29, wherein the helmet body is composed of plastic.

31. A composite helmet according to claim 29, wherein the helmet body is composed of metal.

32. A composite helmet according to claim 29, wherein the hollow molding is attached detachably to the external surface of the helmet body.

33. A composite helmet according to claim 29, wherein the hollow molding is attached undetachably to the external surface of the helmet body.

34. The composite helmet according to claim 29, wherein the hollow molding attached to the helmet body is a hollow molding having an external, truncated, bisymmetric pseudocone shape prepared by cutting off a part of the hollow molding having an external, truncated cone shape vertically to the base of the cone in a certain width along the center line of the base so that the center line comes to the center of the width and integrally bonding the two divisions remaining after the cutting off so as to make the external shape of the resulting hollow molding similar to the external shape of the helmet body.

35. The composite helmet according to claim 34, wherein the hollow molding attached to the helmet body is a hollow molding prepared by putting at least two kinds of hollow moldings having different, external, truncated bisymmetric pseudocone shapes one on another and integrally bonding them so as to make the integrated boundary surface smooth and make the external shape of the resulting hollow molding similar to the external shape of the helmet body.

36. The composite helmet according to claim 35, wherein ceramic chips are fixed on at least a part of the surface of the hollow molding.

37. The composite helmet according to claim 34, wherein the ceramic chips are fixed on at least a part of the surface of the hollow molding.

38. The composite helmet according to claim 29, wherein the helmet body is attached to a hollow molding prepared by putting at least two kinds of hollow moldings having different, external, truncated cone shapes one on another and integrally bonding them so as to make the integrated boundary surface smooth and make the external shape of the resulting hollow molding similar to the external shape of the helmet body.

39. The composite helmet according to claim 38, wherein ceramic chips are fixed on at least a part of the surface of the hollow molding.

40. The composite helmet according to claim 29, wherein ceramic chips are fixed on at least a part of the surface of the hollow molding.

41. A method of making a composite helmet body, comprising:

forming a hollow molding having an external, truncated pyramid shape which is truncated at a point opposite to and farthest from a base of said pyramid shape; and then attaching the hollow molding having the external, truncated pyramid shape to an external surface of a helmet body.

42. The method of making a composite helmet body according to claim 41, further comprising fixing ceramic chips on at least a part of the surface of the hollow molding.

43. The method of making a composite helmet body according to claim 41, further comprising:

putting at least two kinds of hollow moldings having different, external, truncated pyramid shapes one on another; and integrally bonding said at least two kinds of hollow moldings so as to make the integrated boundary surface smooth and make the external shape of the resulting hollow molding similar to the external shape of the helmet body.

44. The method of making a composite helmet body according to claim 41, further comprising:

cutting off a part of the hollow molding having an external, truncated, pyramid shape vertically to the base of the pyramid in a certain width along the center line of the base so that the center line comes to the center of the width; and integrally bonding the two divisions remaining after the step of cutting off so as to make the external shape of the resulting hollow molding similar to the external shape of the helmet body.

45. The method of making a composite helmet according to claim 44, further comprising:

putting at least two kinds of hollow moldings having different, external, truncated bisymmetric pyramid shapes one on another; and integrally bonding said at least two kinds of hollow moldings so as to make the integrated boundary surface smooth and make the external shape of the resulting hollow molding similar to the external shape of the helmet body.

46. A method of making a composite helmet body, comprising:

forming a hollow molding having an external, truncated cone shape which is truncated at a point opposite to and farthest from a base of said cone shape; and then attaching the hollow molding having the external, truncated cone shape to an external surface of a helmet body.

47. The method of making a composite helmet according to claim 46, further comprising fixing ceramic chips on at least a part of the surface of the hollow molding.

48. The method of making a composite helmet body according to claim 46, further comprising:

putting at least two kinds of hollow moldings having different, external, truncated cone shapes one on another; and integrally bonding said at least two kinds of hollow moldings so as to make the integrated boundary surface smooth and make the external shape of the resulting hollow molding similar to the external shape of the helmet body.

49. The method of making a composite helmet body according to claim 46, further comprising:

cutting off a part of the starting hollow molding having an external, truncated, cone shape vertically to the base of the pyramid in a certain width along the center line of the base so that the center line comes to the center of the width; and integrally bonding the two divisions remaining after the step of cutting off so as to make the external shape of the resulting hollow molding similar to the external shape of the helmet body.

50. The method of making a composite helmet according to claim 49, further comprising:

putting at least two kinds of hollow moldings having different, external, truncated bisymmetric pseudocone shapes one on another; and integrally bonding said at least two kinds of hollow moldings so as to make the integrated boundary surface smooth and make the external shape of the resulting hollow molding similar to the external shape of the helmet body.

* * * * *